US007533676B2

(12) United States Patent
Sthair

(10) Patent No.: US 7,533,676 B2
(45) Date of Patent: May 19, 2009

(54) DO-IT YOURSELF REMOVABLE/REUSABLE NON-CHEMICAL HIGHLIGHTS AND HAIR EXTENSIONS

(75) Inventor: Okyo Sthair, Tamarac, FL (US)

(73) Assignee: Aderans Holdings Co., Ltd., Tokyo (JP)

( * ) Notice: Subject to any disclaimer, the term of this patent is extended or adjusted under 35 U.S.C. 154(b) by 663 days.

(21) Appl. No.: 11/179,692

(22) Filed: Jul. 11, 2005

(65) Prior Publication Data

US 2007/0006890 A1 Jan. 11, 2007

(51) Int. Cl.
*A41G 3/00* (2006.01)
*A41G 5/00* (2006.01)

(52) U.S. Cl. ..... 132/201; 132/53

(58) Field of Classification Search ..... 132/201, 132/53, 54–56
See application file for complete search history.

(56) References Cited

U.S. PATENT DOCUMENTS 5,413,124 A * 5/1995 Incando ..... 132/201
5,881,737 A * 3/1999 Nelson ..... 132/201
6,170,491 B1 * 1/2001 Maekawa ..... 132/201
2004/0011371 A1 1/2004 Harrison
2005/0092342 A1 5/2005 Sthair
2006/0169297 A1 * 8/2006 Gill et al. ..... 132/201

FOREIGN PATENT DOCUMENTS

| | | |
|---|---|---|
| CA | 2 486 509 | 5/2006 |
| DE | 202 03 301 | 8/2002 |
| GB | 2 327 605 | 2/1999 |

* cited by examiner

*Primary Examiner*—Robyn Doan
(74) *Attorney, Agent, or Firm*—Wenderoth, Lind & Ponack, L.L.P.

(57) ABSTRACT

Do-it-yourself removable/reusable non-chemical highlight and hair extensions include a plurality of hair strands attached to a base support having a strip of double sided self adhesive tape with a removable backing and extended securing wings. A method of attaching the hair extensions includes separating a user's hair along a part line into an upper portion and a lower portion, placing the unit ⅛" onto the lower portion of the hair with the backing removed from the poly strip containing the supplemental hair, placing the unit flat onto the upper portion of the hair, thus exposing the bottom side of the unit, while containing strands from the lower portion of the hair secured by the attached tape. The backing is removed from the right securing wing which is then folded onto the poly strip, then the left wing's backing is removed and the left wing is folded onto the right wing.

8 Claims, 10 Drawing Sheets

DO-IT YOURSELF REMOVABLE/REUSABLE NON-CHEMICAL HIGHLIGHTS AND HAIR EXTENSIONS

BACKGROUND OF THE INVENTION

1. Field of the Invention

This version of the invention is concerned with the field of devices and methods that provide the appearance of highlighted or thicker hair. More specifically, this version of the invention is concerned with a hair attachment comprised of natural or synthetic hair that is releasably attached directly to the hair of a wearer in order to provide the wearer with the appearance of highlighted and or longer and or thicker hair, without causing any tension to the wearer's scalp and or hair.

It is a common desire among many people to acquire hair that is highlighted, longer and thicker than that which they posses for a variety of reasons, such as self esteem and satisfaction, quickly changing fashion styles, and the like. For example, dark hair, which is in fashion for a period of time, may quickly be replaced as current fashion with lighter, longer fuller hairstyles. As hair grows at the rate of approximately less than one inch per month, many people find that it is exceedingly difficult to acquire a contemporary hairstyle in a reasonable time and without the use of damaging chemicals. Even when someone posses hair of substantial length, the hair may lack thickness or overall volume to achieve a desirable hairstyle. People may also want to add Highlights with out having to cause damage to their own hair.

Various devices and techniques are available in the prior art and in the marketplace that attempt to satisfy the need and desire for highlighted longer and thicker hair. A common well known is a wig. Although wigs provide a quick and simple means to achieve highlighted and or longer hair, they do not present a fully natural appearance, a condition that leads to their recognition when they are being worn. More recently, a variety of more natural hair enhancement techniques have become popular with a variety of users. These consists of hair weaves, hair extensions, hair braiding and the like, whereby natural or synthetic hair is attached to the scalp or existing hair of a wearer by a variety of techniques in order to provide the appearance of highlighted and or longer, thicker hair without the noticeable artifice of a wig. These techniques and systems, which overcome the obvious disadvantage of a wig, also suffer from several many drawbacks as they are relatively expensive and time consuming to acquire and frequently discomfit the wearer during application as well as it may be difficult to maintain without damage to the existing wearers hair.

2. Description of the Prior Art

Numerous designs, devices, and methods for lengthening and enhancement have been provided in the prior art. Even though these designs may be suitable for the specific individual purposes to which they address, they would not be suitable for the purposes of the present version of the invention as they involve relatively elaborate and time consuming techniques and methods as referenced earlier. These techniques are exemplified by U.S. Pat. No. 5,072,745, Hair Extension Process, issued to Cheh on Dec. 17, 1991; U.S. Pat. No. 5,107,867, Process for Extending Human Hair, issued to Barrington on Apr. 28, 1999. U.S. Pat. No. 5,868,145, Hair Extension and Thickening process, issued to Spann on Feb. 9, 1999. U.S. Pat. No. 5,881,737, Method of Attaching A Hair Weft To The Hair Of A Wearer, issued to Nelson on Mar. 16, 1999. U.S. Pat. No. 6,405,736, Method of Using A Self Adhesive Hair Extension, issued to Townsend on Jun. 18, 2002 discloses a hair attachment device designed to provide the appearance of longer, thicker, and fuller hair. The attachment consists of a quantity of natural or synthetic human hair that is sewn to a rectangular shaped, self adhesive tape having a removable back, which is applied to the scalp or hair of a wearer in releasable engagement thereon. While a hair attachment is relatively simple to apply, the self adhesive tape provides a less than adequate means to secure the ends of the strands of natural or synthetic hair, which can become prematurely separated from the self adhesive tape and become unusable in the future.

As such, it may be appreciated that there is a continuing need for a new and improved method and device for providing the appearance of highlighted, longer and thicker hair in a manner that is relatively simple and inexpensive to achieve. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture and with the use of readily available materials.

SUMMARY OF THE INVENTION

The present version of the invention, which will be described in greater detail hereinafter, relates to the field of devices and methods that provide the appearance of highlighted, longer, or thicker hair. More specifically, this version of the invention is concerned with a hair attachment comprised of natural or synthetic hair that is releasably attached directly to the hair of a wearer to provide the wearer with the appearance of longer, thicker or highlighted hair. My version of the invention overcomes all of the shortcomings listed previously, in addition to novel aspects that will be described in detail hereinafter.

Described briefly, according to a typical embodiment, the invention presents a hair attachment device or hair extension that is releasably attached to the hair of a wearer in order to provide the appearance of longer, thicker fuller and or highlighted hair with out the use of chemicals that will cause damage to the wearers hair and or scalp. The hair extension thus allows the wearer to change the appearance of their hair without chemical damage in order to achieve fashion styles that use highlighted, thicker hair or simply to enhance their appearance by achieving particular hair designs heretofore impossible with out the aid of hair extension and or damaging chemicals. The hair extension that is the subject of the instant invention consists of a quantity of natural or synthetic hair strands that are disposed in parallel relation and are attached or secured at one end to a flexible strip of polyurethane. The polyurethane securely anchors the plurality of hair to one end of the double sided adhesive tape so that said strands do not become separated from the self adhesive double face tape. The ventilated poly strip is sufficiently flexible to accommodate the shape of the wearers head. A fastener comprised of a rectangular strip of self adhesive double sided tape with removable backing is attached to the ventilated poly strip in order to provide the adhesion necessary to secure the hair extension to the hair of the wearer. The hair extension can be applied to the wearer's hair in various quantities and locations thereon as needed to achieve the desired look and appearance.

The hair extension may be reused as well by simply wetting the fastener, or double sided self adhesive tape on the hair extension with olive dl or baby oil, separating the tape from the polyurethane base support and or ventilated poly strip, discarding, and a new rectangular strip of double sided self adhesive tape may be reapplied to the polyurethane support unit or ventilated poly strip in order to reuse the hair extension. The strands of hair secured to the ventilated poly strip as referenced earlier can be natural or synthetic and are also available in a variety of textures, colors and lengths.

My invention, therefore, resides not in any one of these features per se, but rather in the particular combination of all of them herein disclosed. It is distinguished from the prior art in this particular combination of all of its structures for the functions specified as follows; can be used on those wearers who have sensitive scalps, for those wanting to achieve highlighted hair with out the use of damaging solutions, or for those who simply desire longer and or thicker hair.

In as much as the foregoing has outlined rather broadly the more pertinent and important features of the present invention in order that the detailed description of the invention that follows maybe better understood so that the present contribution to the art can be more fully appreciated. Additional features of the invention will be described hereinafter. It should he appreciated by those skilled in the art that the conception and the disclosed specific method and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practices and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

Accordingly, it is an object of my version of the invention to provide an easy to use, do-it yourself, comfortable to wear, no tension causing to the scalp or the wearers hair reusable without the use of chemicals hair extension and highlights.

A significant object of the invention is to provide a do-it yourself self adhesive hair extension that is comprised of a strip of polyurethane that has been ventilated with a quantity of parallel arranged natural or synthetic hair strands, then the polyurethane is therefore extended in such manner that car be wrapped around thus creating a sandwich like effect to properly secure the extension to the wearers existing hair with out any possibility of detaching or lifting at the attached corners. Attached to the bottom of the polyurethane is one clear double sided self adhesive tape, which is then secured to the hair of a wearer by then folding the extended polyurethane strip also referred and the wings and thus wrapping it to secure it.

Another very significant object of the invention is to provide a do-it-yourself self adhesive hair extension that provides the appearance of longer, thicker, and or highlighted hair by overcoming the disadvantages of conventional hair enhancing and supplementing devices and techniques, such as wigs, hair weaves and braids, and removable hair extensions and attachments and or chemicals and or solutions to the wearers scalp and or hair.

A final but very important aspect of my invention is it is virtually undetectable to the eye or touch, due to the manner the hair is ventilated through a very thin but durable polyurethane layer and or strip, and then secured by wrapping the extended wings which is then further attached with a double sided self adhesive tape. Thus making it easy to apply by the consumer or by those who specialize in the field.

For a better understanding of the invention, its operating advantages and the specific objects attained by its uses, reference should be made to the accompanying drawings and descriptive matter in which they are illustrated as preferred embodiment of the invention.

The foregoing has outlined some of the more pertinent objects of the invention. These objects should be construed to be merely illustrative of some of the more prominent features and application of the present invention. Accordingly, other objects and a fuller understanding of the invention may be had by referring to the summary of the invention and the detailed description of the preferred embodiment in addition to the scope of the invention illustrated by the accompanying drawings.

BRIEF DESCRIPTION OF THE DRAWINGS

The foregoing and other objects, feature and advantages of the invention will become more fully understood from the following description of the preferred embodiment of the invention as illustrated in the accompanying black and white illustrations in which like reference characters refer to the same parts throughout different views.

DRAWING REFERENCE NUMERALS

10 Do-It-Yourself Removable/Reusable Non-Chemical Highlights and Hair Extension
12 Hair Extension Hair Strands
14 Fastener (self adhesive double sided tape)
16 Securing Wings Made of Extended Polyurethane
18 Polyurethane Strips Ventilated the Supplemental Hair
20 Attached Ends of Hair Strands
22 Unattached Ends of Hair Strands
24 Self Adhesive Double Sided Tape
26 Tape Backing
28 Ventilated Hair Strands within the Poly Strip
30 Wearer
32 Part Line of Hair
34 Upper Portion of Hair
36 Lower Portion of Hair
38 Wearers Natural Hair Strands

DESCRIPTION OF PREFERRED EMBODIMENTS

Figure 1:
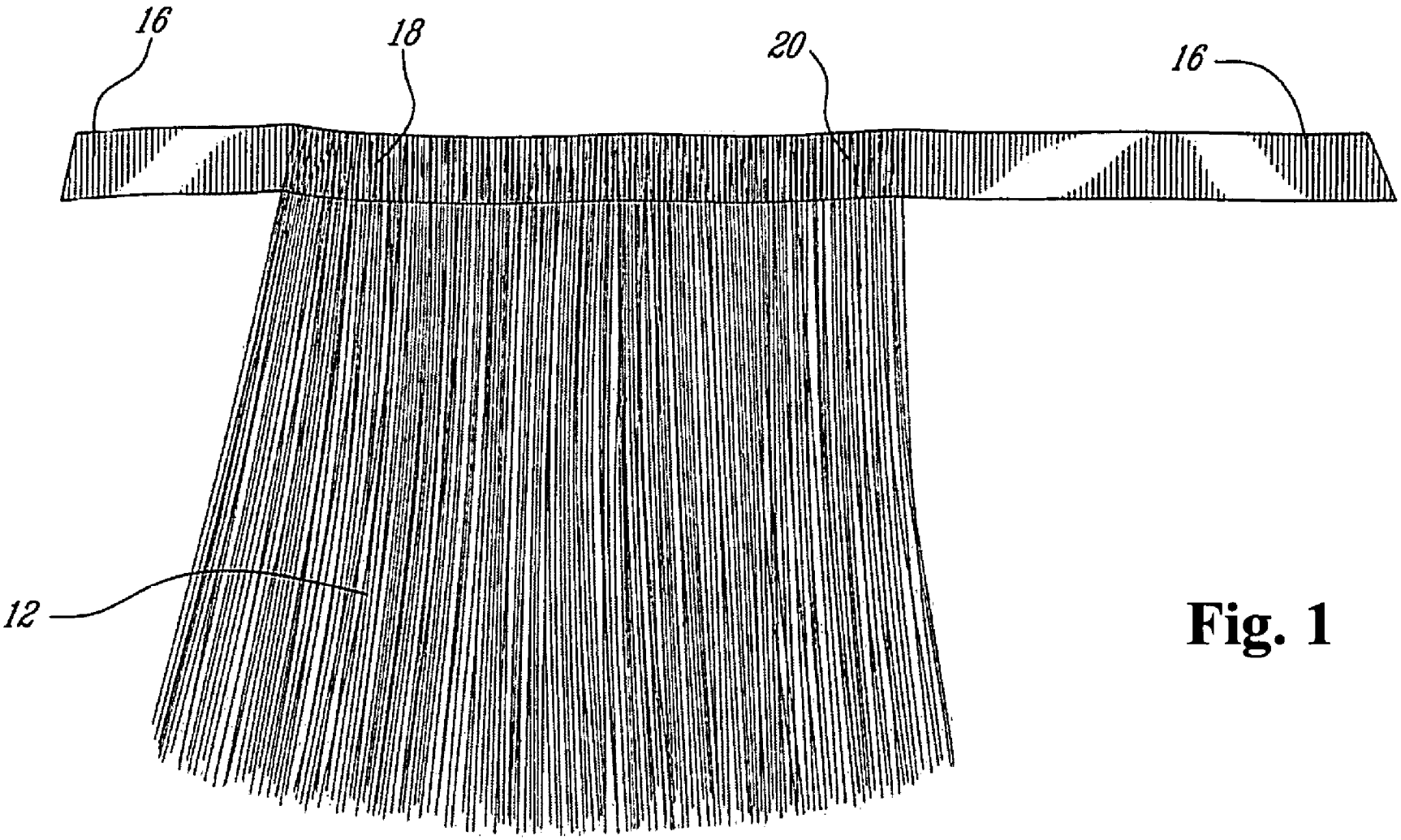
FIG. 1 is an actual view of the do-it yourself, removable/reusable non-chemical highlights and hair extension front complete view.

Referring now to the illustrations and in particular to FIG. 1 wherein there is an actual view of the do-it-yourself, removable/reusable non-chemical highlights and hair extension 10. The present version of the invention 10 consists of a plurality of supplemental hair strands 12. The hair strands 12 are comprised of natural or synthetic supplemental hair in a variety of lengths, diameters, textures, and colors in order to accommodate the desires and needs of a variety of wearers and fashion styles. A quantity of hair strands 12 is arranged generally or typically in parallel arrangement so the strands 12 are aligned at a first attached end 18 and a second attached end 20. Illustrating the securing wings 16 on the left and the right side of the poly strip which is ventilated with the supplemental hair 18.

Figure 2:
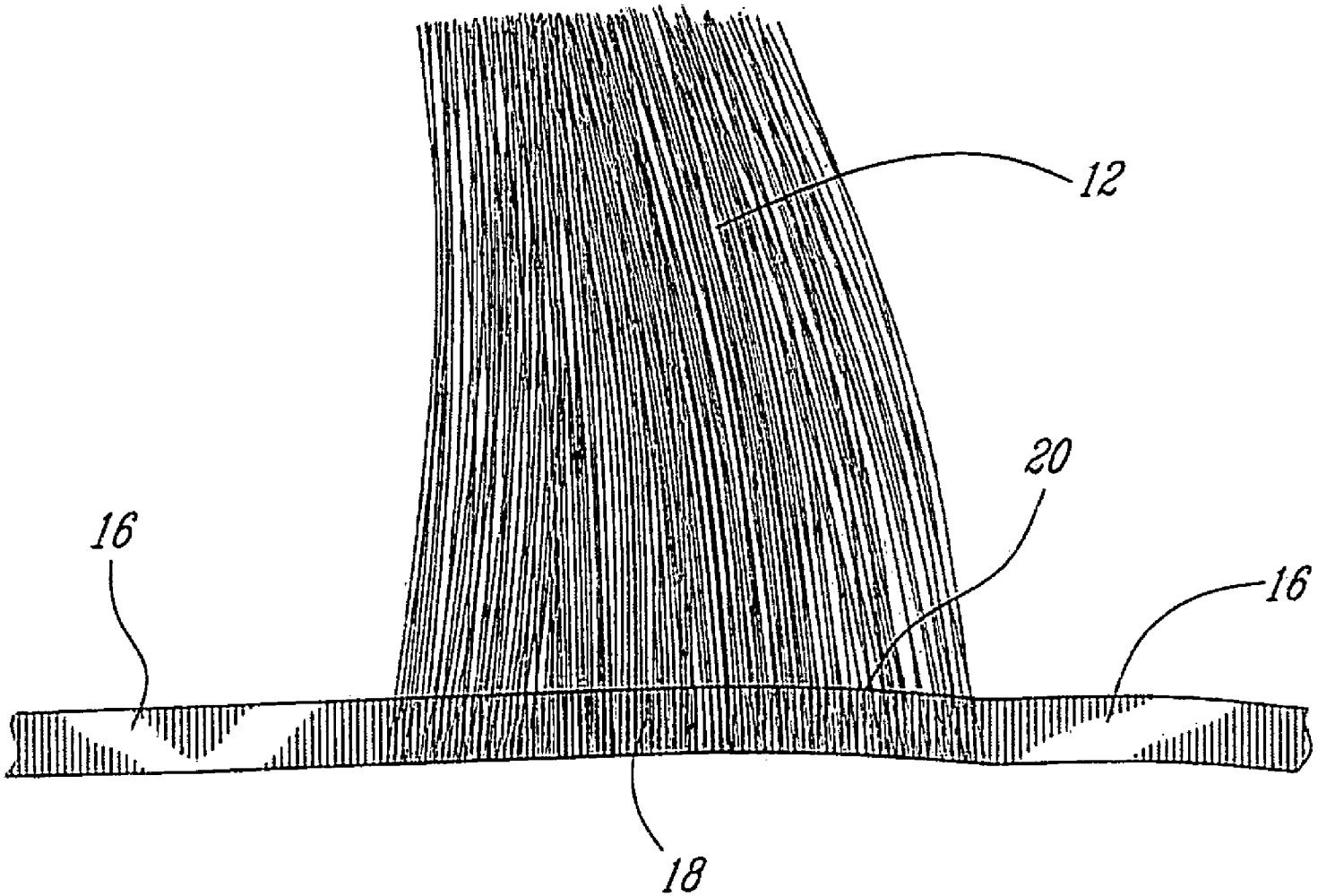
FIG. 2 is an actual view of the back side and/or the attachable side of the do-it-yourself removable/reusable non-chemical highlights and hair extensions.

Referring to FIG. 2 therein illustrated is an enlarged back view of the polyurethane strip 18 containing the attached end of the hair strands which are ventilated 28 thru out the poly strip 18. Illustrating the attachment side of the securing wings 16 to the left and right side of the polyurethane strip that has been ventilated with the supplemental hair 18.

Figure 3:
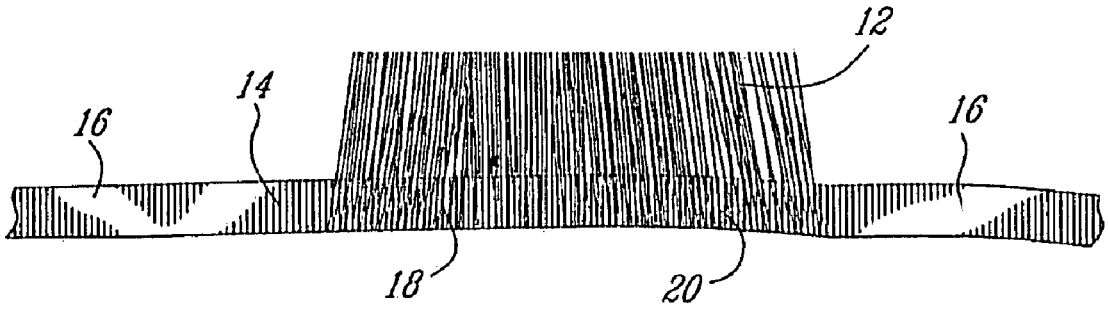
FIG. 3 is an actual view of a seamless self adhesive hair extension with the double sided self adhesive tape or fastener attached to the hair extension system by means of ventilating the hair thru the polyurethane strip, then another coat of polyurethane is applied thus sealing both ends of the base support unit. Then Extending the polyurethane strip on both sides thus creating 2 wings that are then folded onto each other, further secured by the double sided tape. The removable backing is separated from the self adhesive double sided tape or fastener to reveal the construction thereof.

In FIG. 3 therein illustrated is an enlarged back view to reveal its components and construction of said support polyurethane base or referred to as previously the poly strip 18, the hair strands 20 are ventilated thru the polyurethane strip by means of knotting each supplemental hair strand 12 implanting the supplemental hair strands 12 thru the poly strip 18 and reapplying another coat of polyurethane and therefore extending the poly strip to form securing wings 16. Said poly strip 18 and securing wings 16 are comprised of flexible and durable material that conforms to the shape and contour of various scalp and scalp surfaces in order to achieve a comfortable and unobstructed fit thereon. The fastener 14 of double sided self adhesive tape is rectangular and preferably narrow and elongate in order to correspond with the perimeter of the hair attachment poly strip 18. The fastener 14 is comprised of a self adhesive double sided tape 24 and a removable backing 26. The self adhesive double sided tape 24 is secured to the poly strip 18 and the securing wings 16, in order to prevent said tape portion 24 from being separated or repositioned during use.

Figure 4:
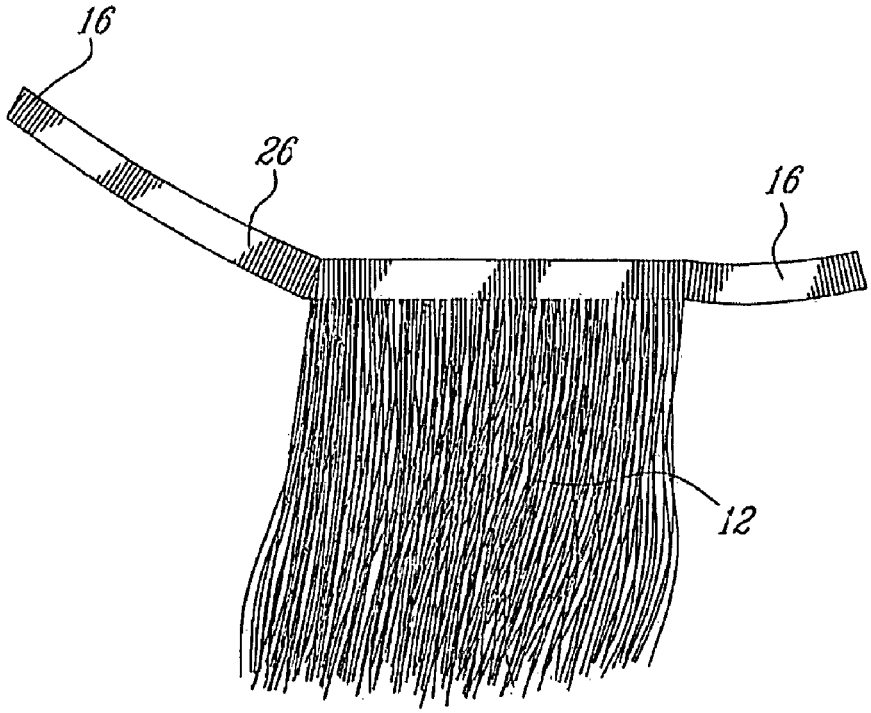
FIG. 4 is an actual view of the back side or the attachable side of the seamless hair extension with the backing attached to the fastener of self adhesive double sided tape.

In FIG. 4 the back view or attachable view of the do-it-yourself, removable, reusable, non-chemical highlights and hair extension system is illustrated with the removable backing 26 attached to the polyurethane strip ventilated with the supplemental hair 18 as well as the securing wings 16.

Figure 5:
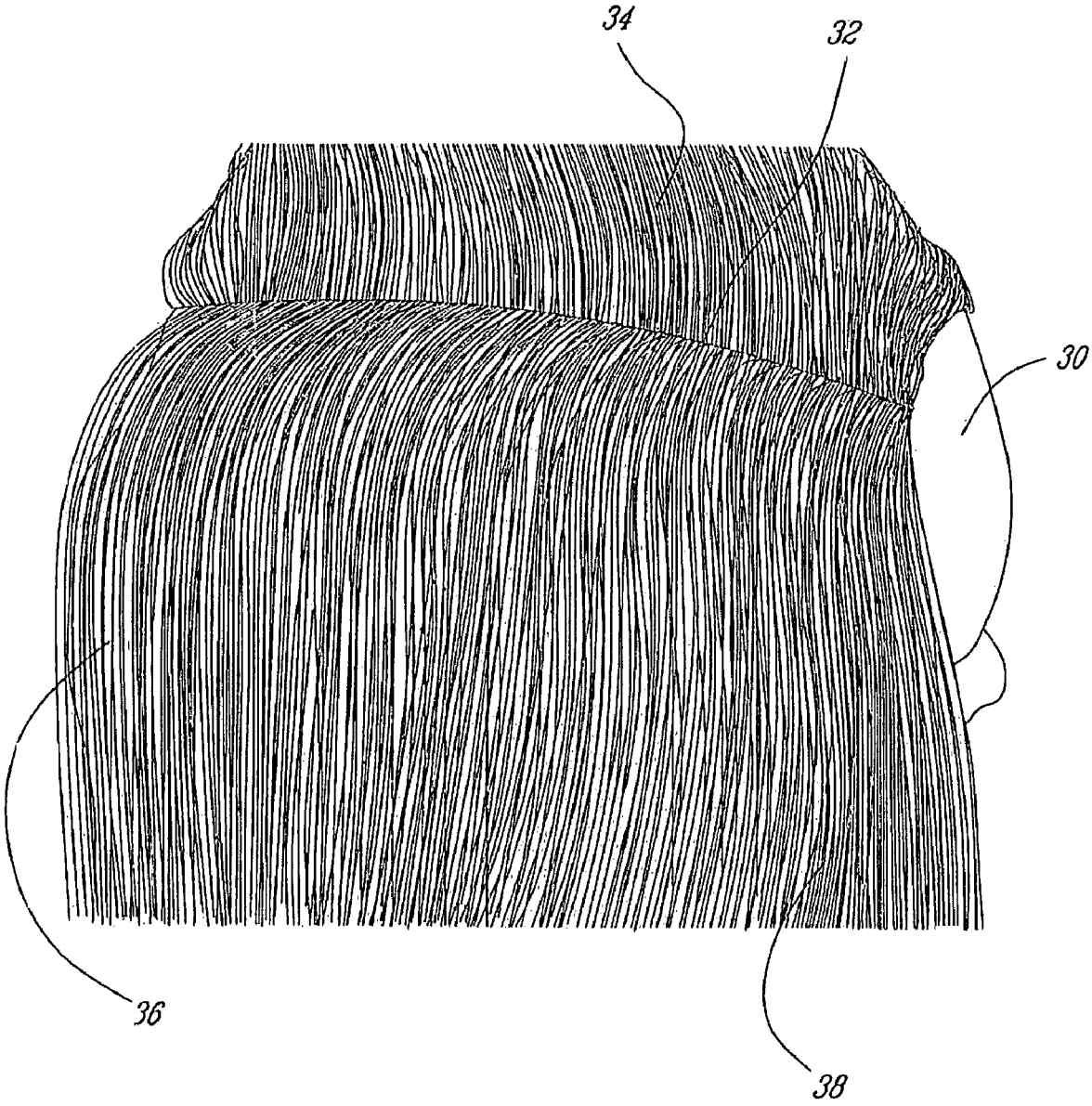
FIG. 5 is an actual view of the process and method of attachment herein referred to as step 1

In FIG. 5 the process and method of attachment referred to as step 1 is illustrated herein, a straight part line 32 is made within the wearer's hair 38, thus separating the upper portion 34 and 36 lower portion of the wearer's hair 38.

Figure 6:
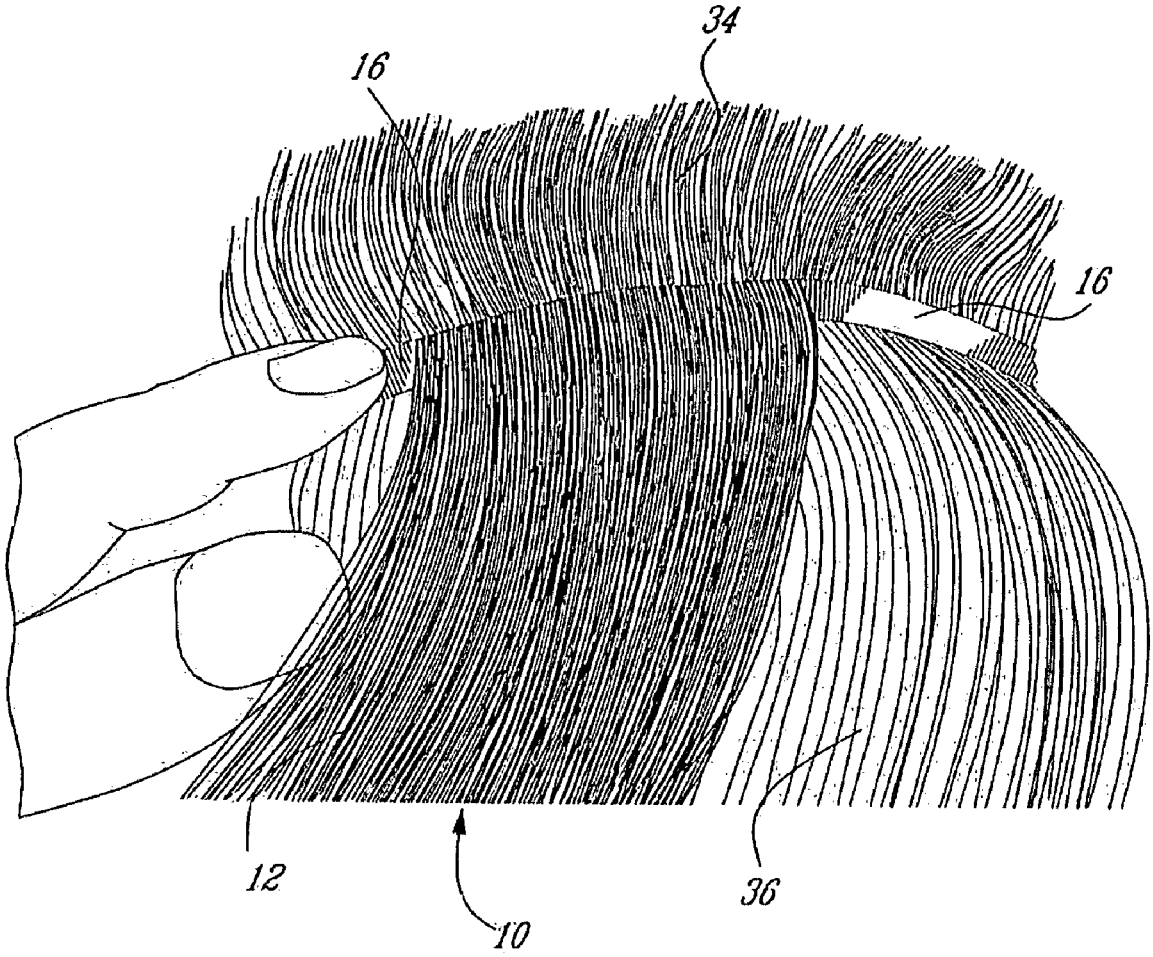
FIG. 6 is an actual view of the process and method of attachment herein referred to as step 2

In FIG. 6. The process and method of attachment referred to as step 2 is illustrated herein, with the upper portion 34 and lower portion 36 secured in an upward position. The unit 40 is then placed ⅛" off the part line 32 with the tape backing 26 removed from the poly strip 18 and with the tape backing 26 still attached upon the securing wings 16. Pressing firmly on the attached end of the hair strands 20 to ensure adhesion to the wearers strands onto the double sided tape 24.

Figure 7:
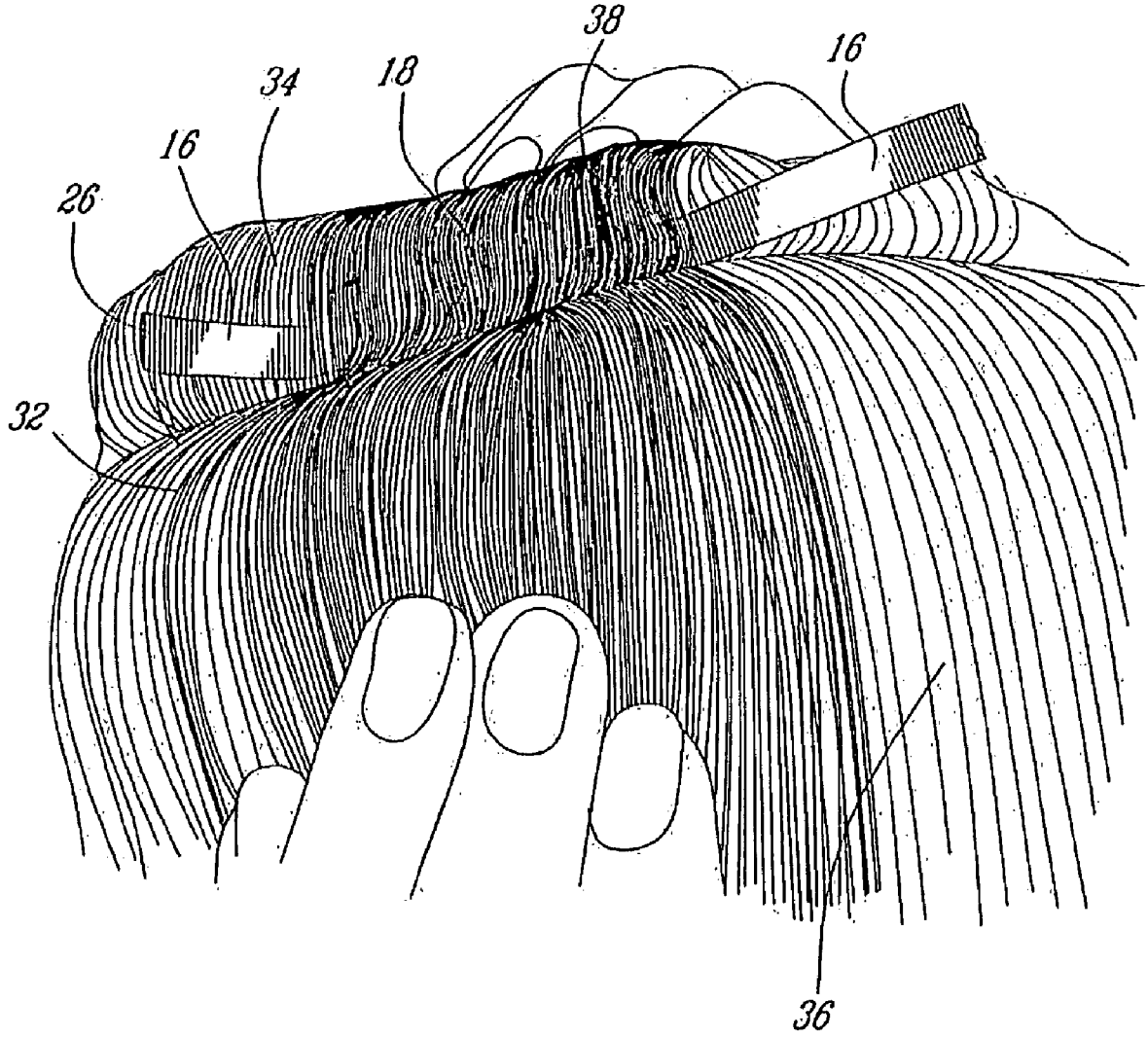
FIG. 7 is an actual view of the process and method of attachment herein referred to as step 3

In FIG. 7 The process and method of attachment referred to as step 3 is illustrated herein, once the unit 40 is securely attached ⅛" of an inch from the wearers part line 32, then one would turn the unit 40 over, thus laying said unit flat onto the upper portion of the wears hair 34. As described in step 2, an adhesion of the wearers natural strands are therefore attached to the poly strip 18 that is ventilated with the supplemental hair.

Figure 8:
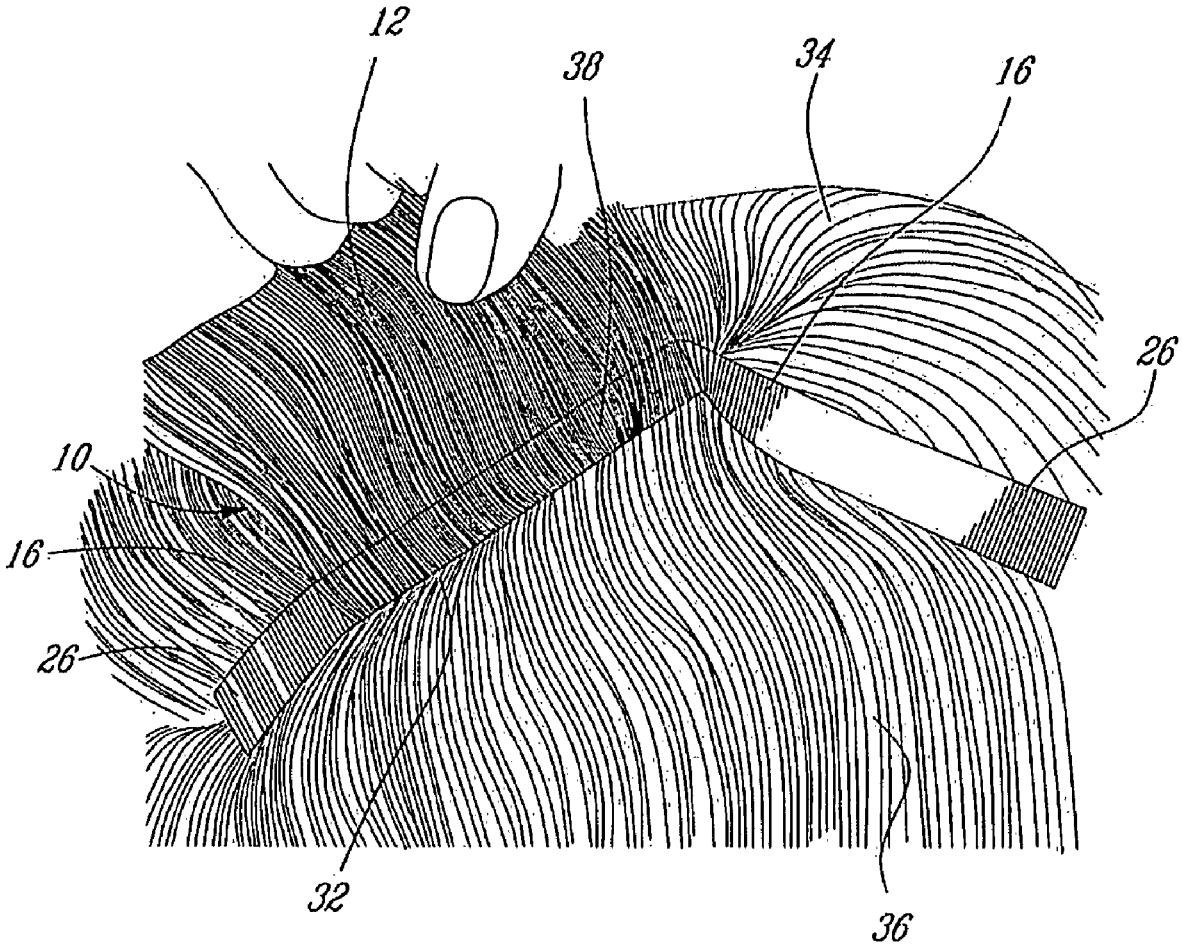
FIG. 8 is an actual view of the process and method of attachment herein referred to as step 4

As follows in FIG. 8, the process and method of attachment referred to as step 4 is illustrated herein, the tape backing 26 is then removed from the right securing wing 16 while the unit is in a flat position upon the upper portion 36 the wears hair.

Figure 9:
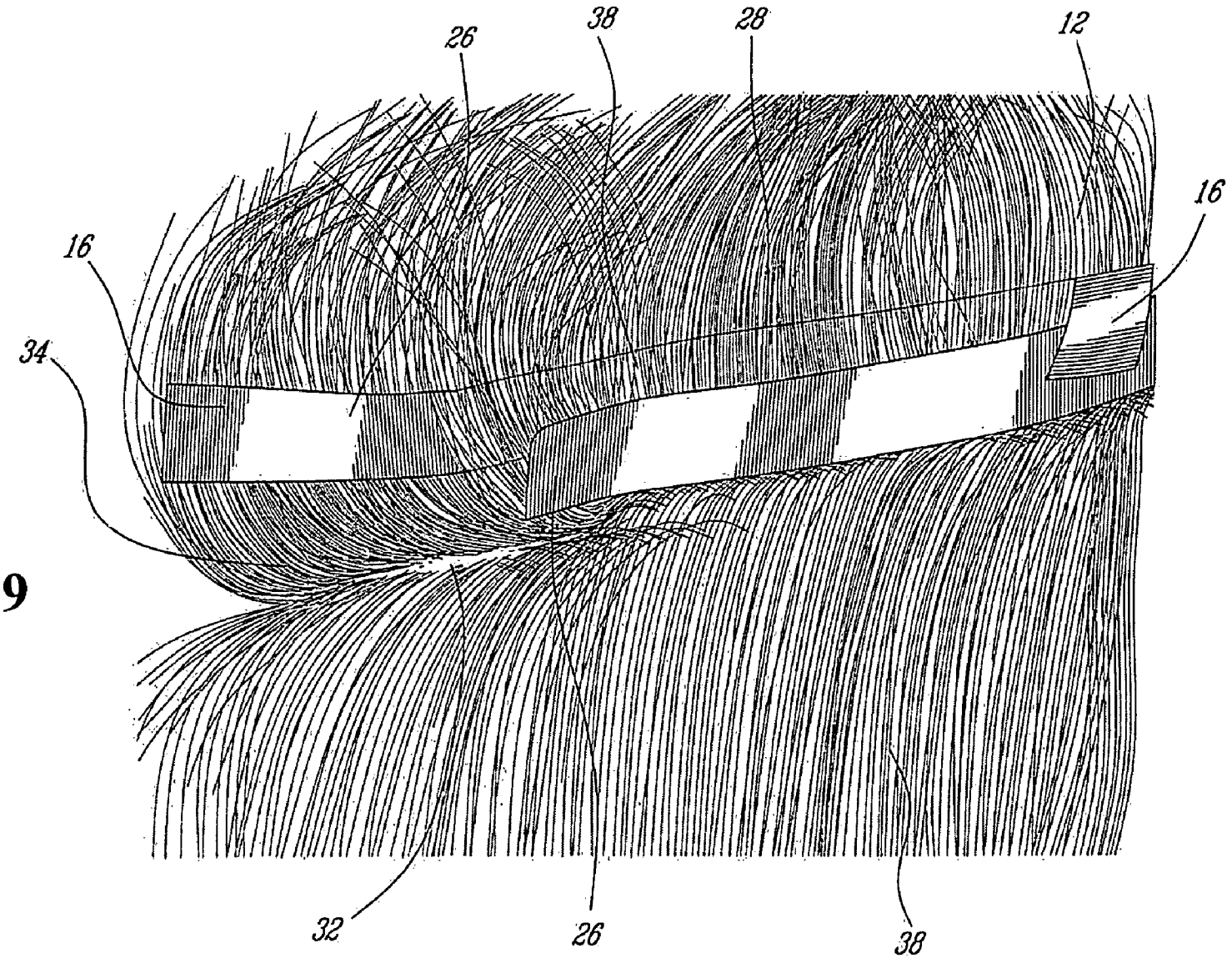
FIG. 9 is an actual view of the process and method of attachment herein referred to as step 5

In FIG. 9 The process and method of attachment referred to as step 5 is illustrated herein, with the tape backing removed 26 from the right securing wing 16, the right securing wing 16 is therefore folded onto the bottom exposed poly strip which herein contains the wearers natural strands 38 thus previously secured in step 4.

Figure 10:
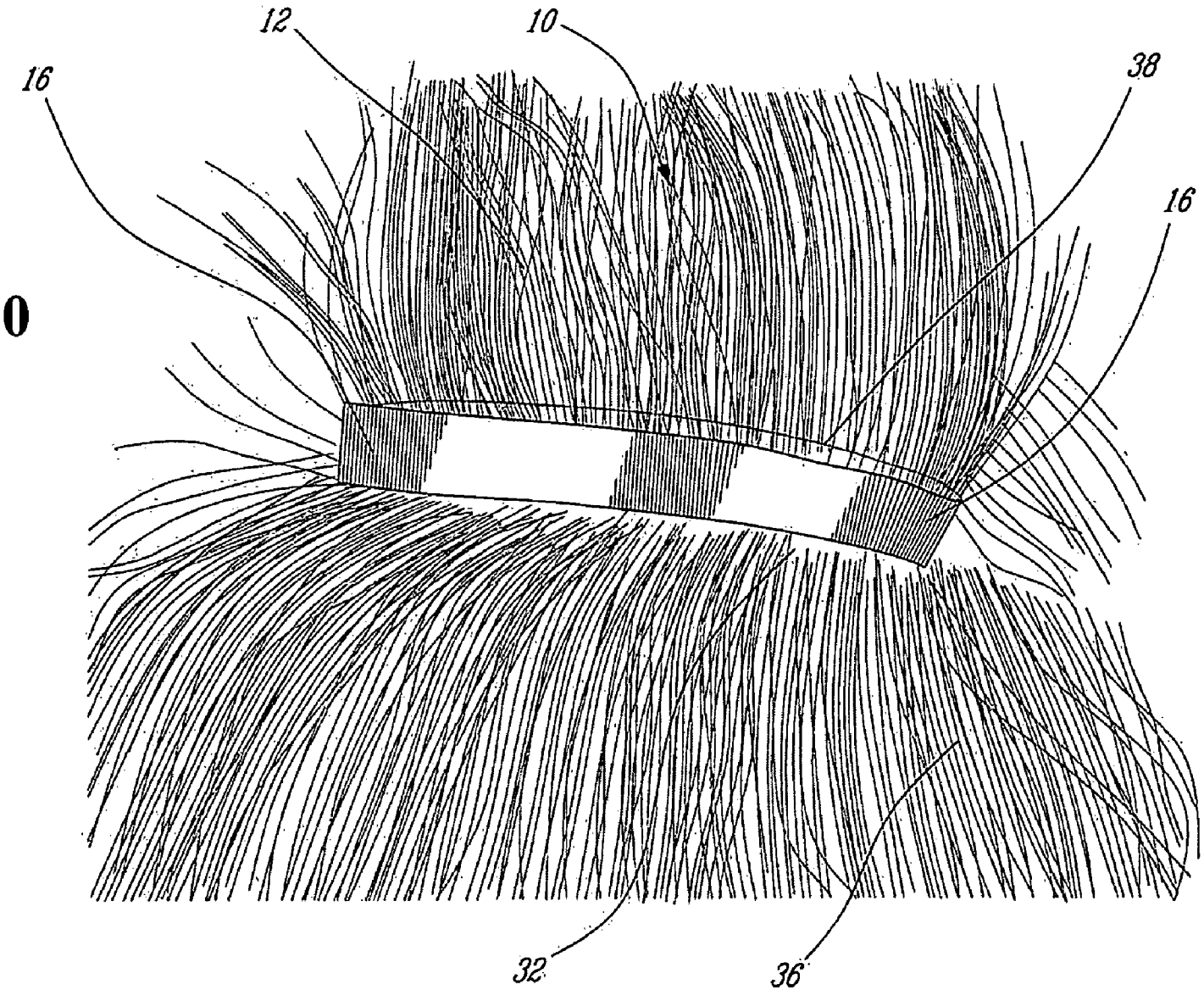
FIG. 10 is an actual view of the process and method of attachment herein referred to as step 6

In FIG. 10 the process and method of attachment referred to as step 6 is illustrated herein, with the right securing wing 16 in the folded position, remove the tape backing 26 from the left securing wing and fold onto the left securing wing, thus creating a seal.

Figure 11:
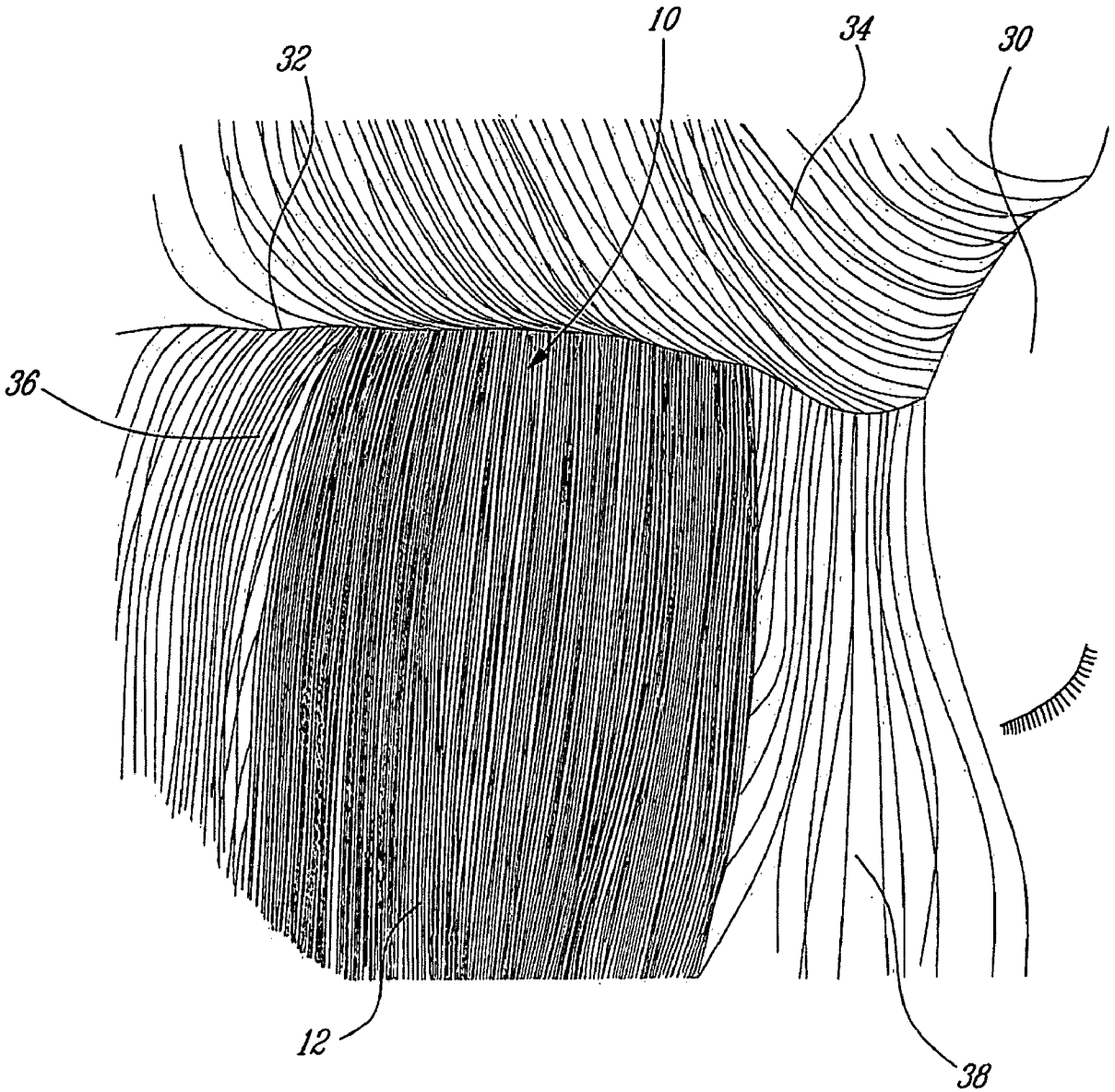
FIG. 11 is an actual view of the process and method of attachment herein referred to as step 7

In FIG. 11 The process and method of attachment referred to as step 7 is illustrated herein, once both right and left securing wings are closed onto the poly strip containing the supplemental hair 18, turn the unit 40 back onto the lower part of the wearers hair. Once the hair is in its original position, it will conceal the poly strip 18 resulting in a lifelike natural appearance of highlighted hair as well as thicker hair. Of course the hair extension 10 can be attached to the head of the wearer 30 in a variety of styles and quantities and at an assortment of locations and positions, thereon with placement only limited by the imagination of the consumer. It should be recognized that the example of attachment described previously by no means limits the spirit and scope of the invention 10 and that all possible variation of attaching the do-it-yourself reusable/removal non chemical highlights and hair extension 10 to either the hair or scalp of a wearer remains within the purview of the instant invention.

As this version of the invention and method has been illustrated and described in detail in the illustrations and foregoing description, the same is to be considered as illustrative and not restrictive in character, it being understood that only the preferred embodiment has been shown and described and that all changes and modification that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the illustrations and described in the specifications are intended to be encompassed by the present invention.

I claim:

1. A method for attaching do-it-yourself removable, reusable, hypoallergenic, non-chemical highlights, self adhesive hair extensions to the hair of a wearer, the method comprising:

a) forming a do-it-yourself removable, reusable, hypoallergenic, non-chemical highlights, self adhesive hair extension by arranging a quantity of natural or synthetic hair strands in a parallel arrangement so that the hair strands are aligned at a first attached end and a second attached end;

b) securing the first attached end of the hair strands to a polyurethane base support;

c) extending the polyurethane to form a left and a right securing wing;

d) attaching a rectangular shaped, clear double sided self adhesive tape having a removable backing to the polyurethane support unit which has been ventilated with the natural or synthetic supplemental hair, as well as to the left and right securing wings;

e) forming a part line on the head of a wearer to form an upper portion of hair and a lower portion of hair;

f) temporarily sweeping the upper and lower portion of hair away from the part line and securing it;

g) removing the tape backing from a middle section and/or a section that has the ventilated supplemental hair;

h) placing the unit onto the lower portion of the wearer's hair ⅛" away from the part line such that the wearer's hair automatically adheres onto the clear double face tape;

i) turning the unit towards the upper portion of the part line, removing the tape backing from the right securing wing, then folding the right securing wing onto the middle section and/or the section that is ventilated with supplemental hair, the same is to be done to the left wing; and j) putting the upper portion of the wearer's hair back to the original position, mixing the supplemental hair with the wearer's hair and repositioning the lower portion of the wearer's hair.

2. The method according to claim 1, wherein the natural or synthetic hair strands have a predetermined length.

3. The method according to claim 2, wherein the removable backing of the rectangular shaped, clear double sided self adhesive tape consists of the middle section, and left and right wings, each of which is removable independently.

4. The method according to claim 1, wherein the removable backing of the rectangular shaped, clear double sided self adhesive tape consists of the middle section, and left and right wings, each of which is removable independently.

5. A do-it-yourself removable, reusable, hypoallergenic, non-chemical highlights, self adhesive hair extension which comprises:

a) a quantity of natural or synthetic hair strands being arranged in a parallel arrangement so that the hair strands are aligned at a first attached end and a second attached end;

b) a polyurethane base support having a middle section, the first attached end of the natural or synthetic hair strands being secured to the middle section;

c) a left and right securing wings which are extended from said polyurethane base support; and d) a rectangular shaped, clear double sided self adhesive tape with a removable backing being attached to the polyurethane support which has been ventilated with the natural or synthetic supplemental hair, as well as to the left and right securing wings.

6. The do-it-yourself removable, reusable, hypoallergenic, non-chemical highlights, self adhesive hair extension according to claim 5, wherein the natural or synthetic hair strands have a predetermined length.

7. The do-it-yourself removable, reusable, hypoallergenic, non-chemical highlights, self adhesive hair extension according to claim 6, wherein the removable backing of the rectangular shaped, clear double sided self adhesive tape consists of the middle section, and left and right wings, each of which is removable independently.

8. The do-it-yourself removable, reusable, hypoallergenic, non-chemical highlights, self adhesive hair extension according to claim 5, wherein the removable backing of the rectangular shaped, clear double sided self adhesive tape consists of the middle section, and left and right wings, each of which is removable independently.

* * * * *